US008950336B2

(12) United States Patent
Camp et al.

(10) Patent No.: US 8,950,336 B2
(45) Date of Patent: Feb. 10, 2015

(54) MONORAIL VEHICLE APPARATUS WITH GRAVITY-CONTROLLED ROLL ATTITUDE AND LOADING

(71) Applicant: QBotix, Inc., Menlo Park, CA (US)

(72) Inventors: John S. Camp, San Francisco, CA (US); Benjamin D. Sumers, Los Altos Hills, CA (US); Ryan P. Feeley, San Francisco, CA (US); Kevin T. Mori, Stanford, CA (US); Daniel I. Fukuba, San Francisco, CA (US); Wasiq Bokhari, Half Moon Bay, CA (US)

(73) Assignee: QBotix, Inc., Menlo Park, CA (US)

( * ) Notice: Subject to any disclaimer, the term of this patent is extended or adjusted under 35 U.S.C. 154(b) by 167 days.

(21) Appl. No.: 13/724,417

(22) Filed: Dec. 21, 2012

(65) Prior Publication Data

US 2014/0174315 A1 Jun. 26, 2014

(51) Int. Cl.
*B61B 13/04* (2006.01)

(52) U.S. Cl.
CPC ..... *B61B 13/04* (2013.01)
USPC ..... 104/119; 105/141

(58) Field of Classification Search
CPC ..... B61B 3/00; B61B 3/02; B61B 10/00; B61B 10/02; E01B 5/00; E01B 5/02; E01B 25/00; E01B 25/08; E01B 25/10; E01B 25/12
USPC ..... 104/89–91, 118–121; 105/141, 142, 105/144–147
See application file for complete search history.

(56) References Cited

U.S. PATENT DOCUMENTS

| | | | | |
|---|---|---|---|---|
| 3,198,139 | A | 8/1965 | Dark | |
| 3,286,651 | A | 11/1966 | Dahl, Jr. | |
| 3,319,581 | A | 5/1967 | Churchman et al. | |
| 3,865,040 | A | 2/1975 | Steen | |
| 3,890,904 | A | 6/1975 | Edwards | |
| 3,935,822 | A | 2/1976 | Kaufmann | |
| 3,985,081 | A | 10/1976 | Sullivan, II | |
| 4,000,702 | A | 1/1977 | Mackintosh | |
| 4,690,064 | A | 9/1987 | Owen | |
| 4,996,928 | A | 3/1991 | Janssen et al. | |
| 5,934,198 | A | 8/1999 | Fraser | |
| 6,446,560 | B1 | 9/2002 | Slocum | |
| 6,523,481 | B2 | 2/2003 | Hara et al. | |
| 6,877,439 | B2 * | 4/2005 | Chapman | 104/118 |
| 7,341,004 | B2 | 3/2008 | Sullivan, II | |
| 7,380,507 | B2 | 6/2008 | Sullivan, II | |
| 7,823,512 | B2 | 11/2010 | Timan et al. | |
| 2006/0213387 | A1 | 9/2006 | Sullivan, II | |

* cited by examiner

*Primary Examiner* — R. J. McCarry, Jr.
(74) *Attorney, Agent, or Firm* — Marek Alboszta

(57) ABSTRACT

Monorail vehicle that travels on a non-featured rail with substantial profile variation and controls roll attitude, lateral location, and loading through judicious placement of the vehicle's center of gravity without using springs or suspensions. The vehicle has a bogie for engaging the non-featured rail so the center of gravity has a lateral offset $r_1$ from the rail centerline to produce a roll moment $N_r$ determined by vehicle's mass and value of $r_1$. The center of gravity also has a vertical offset $r_2$. The bogie uses first and second assemblies for engaging the rail to produce a pair of surface normal reaction forces to thus control roll attitude and loading by the placement of the center of gravity, thereby enabling accurate alignment of the monorail vehicle.

31 Claims, 11 Drawing Sheets

MONORAIL VEHICLE APPARATUS WITH GRAVITY-CONTROLLED ROLL ATTITUDE AND LOADING

FIELD OF THE INVENTION

This application is related to monorail vehicle apparatus and methods for constraining the roll attitude, lateral location and loading of such monorail vehicle, and more precisely still, to constraining the roll attitude, lateral location and loading through appropriate placement of the center of gravity of the monorail vehicle at a certain offset to the non-featured rail, as well as appropriate placement of assemblies that interface with the non-featured rail.

BACKGROUND ART

Many types of cars, carts, vehicles and trolleys are supported on bogies or trucks that are designed for engagement with and travel on non-featured rails. A subset of such vehicles constrained to travel on rails includes those engineered for travel on a single rail. The latter are commonly referred to as monorail vehicles. The design and manner of engagement between carriages or bogies of monorail vehicles and the non-featured rail or monorail presents a number of challenges specific to these vehicles.

First, the six degrees of freedom of a vehicle traveling on a monorail must be constrained. Traditionally, these degrees of freedom include the three linear degrees of freedom, namely: longitudinal translation along the rail, lateral translation and vertical translation. There are also the three rotations, namely: rotation about the longitudinal direction (roll), rotation about the lateral direction (pitch), and rotation about the vertical direction (yaw).

Typically, translation along the longitudinal direction (along the rail) is controlled by traction systems of the monorail and therefore does not need to be controlled by the suspension system or bogie. Lateral translation is usually constrained with wheels located on either side of the monorail. Vertical translation is often controlled with wheels located on the top and/or on the bottom surfaces of the monorail. Yaw may be controlled with two wheels that resist lateral translation and are spaced by a certain distance along the longitudinal direction. Similarly, pitch may be controlled with two wheels that are also spaced longitudinally and resist vertical translation.

Roll, the rotation about the longitudinal direction or about the rail is more challenging to constrain. The prior art teaches a number of approaches to limit roll and control roll attitude. These teachings typically fall into one of two general approaches or a combination thereof.

According to the first approach, systems deploy rails with features spread far apart and designed to interface with the bogie. Separately, or in combination, bogie-restraining provisions can be provided to control the roll or maintain a certain roll attitude. In addition, the wheels including traction wheels, support wheels, guide wheels or idler wheels belonging to the bogies and their assemblies may have rims or other structures to help arrest roll. Furthermore, the placement of the center of gravity of the monorail vehicle is used to aid in constraining roll. There are a number of exemplary teachings that fall within this first approach.

For example, U.S. Pat. No. 3,935,822 to Kaufmann teaches a monorail trolley designed to travel on a monorail and having a truck in which the center of gravity of both the loaded and empty trolley truck is displaced with respect to the points of contact between the rail and the supporting wheel and the counter-wheel to cause both wheels to engaged firmly and adhere to the rail. Kaufmann's design accommodates rapid and easy placement of the truck on the monorail and permits the trolley to move up and down grades. However, Kaufman's monorail trolley does not teach to control forces on lateral wheels to control the roll axis and roll attitude and it does not support accurate trolley localization on a non-featured rail. Furthermore, this design is not appropriate for rail that has have long unsupported spans that place restrictions on minimum torsional stiffness, minimum lateral bending stiffness, minimum vertical bending stiffness and maximum material stress.

U.S. Pat. Nos. 3,985,081; 7,341,004; 7,380,507 and U.S. Published Application 2006/0213387 all to Sullivan also teach a rail transportation system and methods in which vehicles on tracks have a center of gravity outside the contact surfaces between the motorized and counterbalance wheels. Because the center of gravity acts outside of the surfaces of contact between the transport unit and the track, the unit will be stable and a sufficiently high force will be generated between the drive wheels and the track web to assure adequate traction over the entire transportation system. Sullivan further suggests that the unit should resist "sway" and "roll" caused by dynamic loading introduced by movement of the units over the track.

However, Sullivan's solutions require at least one beam extending between the guide ways for absorbing torsional forces caused by the composite centers of gravity of the vehicles being offset from the tracks. In fact, a transportation system as taught by Sullivan incurs high torsional forces that would not be appropriate in situations deploying rails having substantially varying profiles (e.g., low-grade stock rails whose cross-sections exhibit substantial profile variation) and rails that contemporaneously have long unsupported spans that place restrictions on minimum torsional stiffness, minimum bending stiffness and maximum material stress.

Further teachings are provided in U.S. Pat. No. 7,823,512 to Timan. Timan's monorail car travels on a monorail track of uniform cross-section and includes guide wheels, load bearing wheels and stabilizing wheels to provide for good travel. Again, although Timan's solutions use uniform cross-section rails and address the roll of the monorail bogie, they are not appropriate for rails whose cross-sections exhibit substantial profile variation and require a vehicle with a multitude of mechanisms for controlling the monorail bogie with respect to the rail.

Still further notable teachings that fall into the first approach are found in U.S. Pat. No. 4,000,702 to Mackintosh; U.S. Pat. No. 6,446,560 to Slocum. In contrast to these solutions, the second general approach involves the use of large springs and/or hydraulic systems to clamp the rail. One advantage of these approaches is the expanded ability to use non-featured rails that are typically more readily available and lower cost. Some systems that deploy springs and/or hydraulics as well as other related solutions are described in U.S. Pat. No. 3,198,139 to Dark; U.S. Pat. No. 3,319,581 to Churchman et al.; U.S. Pat. No. 3,890,904 to Edwards and U.S. Pat. No. 6,523,481 to Hara et al.

Unfortunately, deployment of large opposing springs to clamp the rail is undesirable in many applications. Such mechanisms involve many parts, are unreliable and contribute to vehicle cost and mass.

Further, in the case in which the apparatus must use an unsupported guide rail that is as small and inexpensive as possible and the vehicle of the apparatus must be accurately located, the prior art does not produce a satisfactory solution. Such an inexpensive guide rail is necessarily small, to minimize material use, and exhibits substantial profile variation, to allow for loose manufacturing processes. Further, as the rail is unsupported over long lengths, such a rail would be additionally constrained by limitations on minimum torsional stiffness, minimum lateral bending stiffness, minimum vertical bending stiffness and maximum material stress. These additional requirements mean that the featured cross-sections as taught in the first general approach in the prior art are not viable for unsupported spans. A vehicle would therefore have to interface with a rail without the multiple features to which a vehicle could interface as shown in the prior art. Thus, the prior art struggles to deliver accurate location of a vehicle under these constraints.

For example, in order to locate a point 200 mm away from the rail to within 2 mm, a typical vehicle attached to a rail of a maximum of 100 mm height would require opposing springs on the order of 400 N/mm. Further, on a rail with loose manufacturing tolerances, one would expect variation in thickness of +/−2 mm. To guarantee contact with the rail, a vehicle on such a rail would require springs installed at a nominal deflection of 2 mm, which would translate to an initial preload of 800 N on each wheel. A high preload creates high rolling resistance, increases wheel wear, and increases the amount of deflection seen by the wheel, making this solution undesirable. In other words, a suspension system compatible with low-cost rail using opposing springs would either inaccurately locate to the rail or require excessive preloads to ensure contact during vehicle travel.

Thus, prior art approaches exhibit many limitations that render them inappropriate for controlling roll in monorail vehicles that are deployed on low-cost, low-quality, non-featured stock rails with substantially varying profiles and requiring long unsupported spans.

OBJECTS OF THE INVENTION

In view of the above shortcomings of the prior art, it is an object of the present invention to provide for monorail vehicle apparatus and methods that enable deployment of low-cost, low-quality, off-the-shelf (stock) rails including those with a rectangular or square cross-sections and substantial profile variation while retaining the advantages of constant contact force on the bogie's roll-control wheels as well as accurate constraint of roll attitude and lateral translation.

Further, it is an object of the invention to provide monorail vehicles that dispense with expensive and generally failure-prone mechanisms such as suspensions including springs or opposing wheels, while meeting the above requirements.

It is still another object of the invention to provide for monorail vehicle bogies with fewer wheels than typically required in mechanisms with opposing springs, and to generate forces that control roll attitude and loading of the monorail vehicle by means of a judicious placement of its center of gravity.

Additional objects and advantages of the present invention will become evident upon reading the detailed description in conjunction with the drawing figures.

SUMMARY OF THE INVENTION

Some of the objects and advantages of the invention are secured by a monorail vehicle apparatus whose roll attitude and loading (as well as its lateral translation) are constrained by the placement of a center of gravity of the monorail vehicle. Besides the monorail vehicle itself, the apparatus has a non-featured rail that extends along a rail centerline. A non-featured rail according to the invention does not have any additional features, such as extrusions or faces designed to interface with the monorail vehicle. In fact, in many embodiments the non-featured rail is embodied by stock rail with standard rectangular cross-section and substantial profile variation.

The monorail vehicle has a bogie for engaging the non-featured rail in such a way that the center of mass or center of gravity of the monorail vehicle exhibits a lateral offset $r_1$ from the rail centerline. The result is a roll moment $N_r$ about the centerline. The value of roll moment $N_r$ is determined by the mass of the monorail vehicle and the value of lateral offset $r_1$.

The bogie has a drive mechanism for moving or displacing the monorail vehicle along the non-featured rail in either direction. The bogie also has a first assembly for engaging the non-featured rail on a first rail surface and a second assembly for engaging on a second rail surface. The bogie resists the roll moment $N_r$ with the two assemblies that engage the non-featured rail on the two rail surfaces. In accordance with the invention, these first and second rail surfaces are chosen such that a pair of surface normal reaction forces is produced on the bogie, resulting in the roll attitude, lateral translation and loading of the monorail vehicle being constrained by the placement of the center of gravity. This approach supports accurate alignment of the bogie and therefore of the monorail vehicle.

Additionally, the center of gravity is also located with a vertical offset $r_2$ from the rail centerline. More precisely, the center of gravity is at vertical offset $r_2$ to the rail centerline. Preferably, in order to keep the robot in its nominal position in spite of external forces or imposed displacements, the vertical offset $r_2$ is below the rail centerline.

In many embodiments the first and second rail surfaces are geometrically opposite. This is practical when the rail cross-section along the rail centerline is rectangular or square.

An important aspect of the invention is the ability of the monorail vehicle to travel along rails whose cross-section exhibits a substantial profile variation along the centerline without variation in wheel loading. In other words, gravity-constrained roll, lateral translation and loading of monorail vehicle in accordance with the invention, permit the monorail vehicle to travel along rails whose rail cross-sections are not well controlled (e.g., low quality, irregular rails).

In the preferred embodiment, the first assembly has one or more idler wheels. Similarly, the second assembly also has one or more idler wheels. Of course, it is also possible for the assemblies to use other glide elements, such as runners of a low-friction material. Furthermore, the preferred drive mechanism has a drive wheel that is engaged with a top surface of the non-featured rail. Of course, the monorail vehicle can travels along the rail in either direction with the aid of the drive mechanism.

Monorail vehicle apparatus of the invention takes advantage not only of non-featured rails (also sometimes referred to as guide rails) with irregular cross-sections exhibiting substantial profile variation, but is also designed to allow the apparatus to use closed cross-sections for the non-featured rail such as rectangles. Such a closed cross-section allows the apparatus to include long unsupported spans with a minimum of material. An unsupported span of the rail between docking locations has a length that is determined by a minimum torsional stiffness, minimum lateral bending stiffness, minimum vertical bending stiffness and maximum material stress of the non-featured rail. Stiffness is known to depend on rail cross-section as well as the properties of the material of which it is made and other intrinsic and extrinsic factors.

In certain embodiments, the monorail vehicle has an adjustment mechanism for adjusting a geometry of the monorail vehicle. The adjustment affects at least one component belonging to one or more of the first and second assemblies and/or the drive mechanism. Preferably, the adjustment mechanism performs the adjustment by moving the center of gravity of the monorail vehicle. Alternatively, or in combination with moving the center of gravity, the adjustment mechanism can move [the ]at least one component of the first and second assemblies or of the drive mechanism. Specifically, the relevant component can be a wheel belonging to either of the two assemblies or the drive mechanism and the adjustment mechanism can move that wheel.

The invention also extends to a method for controlling roll attitude, lateral translation and loading of the monorail vehicle that travels along the non-featured rail with the aid of gravity, rather than springs. As indicated above, the non-featured rail has a certain cross-section defined along its centerline.

According to the methods of invention, the bogie is provided with the first and second assemblies for engaging on first and second rail surfaces, respectively. The first and second rail surfaces are selected to generate a pair of surface normal reaction forces for achieving control of roll attitude by gravity alone; i.e., by using the mass of the monorail vehicle. Further, the center of gravity is also located at vertical offset $r_2$.

The selection of the first and second surfaces is dictated to a large extent by the cross-section of the rail, which is typically a substantially varying cross-section. In some cases, the first and second surfaces can be geometrically opposite each other, e.g., when the cross-section is rectangular or square.

In applications where the monorail vehicle travels to one or more docking locations, corresponding alignment data can be provided for locating the bogie at the corresponding docking location. An outrigger assembly, such as a wheel, can also be provided for assisting in the location of the bogie at the docking location. Such an outrigger would allow for accurate alignment of the vehicle at a particular point while relaxing alignment at areas where the outrigger wheel is not in contact. In turn, this permits the deployment of guide rails with even greater variation and therefore likely of lower cost. Further, outrigger assemblies allow for variation in the vehicle, e.g. mass growth, wear or deflection, without adverse effects on system performance. These measures are particularly useful in embodiments where monorail vehicle is to perform some specific functions at the docking locations.

In certain embodiments the apparatus has an alignment datum for locating the bogie at a first docking location. In such embodiments, it is convenient to provide the monorail vehicle with an outrigger wheel for assisting in locating the bogie at the docking location. In the same or different embodiments, the rail of the apparatus can be designed for guiding the monorail vehicle between the first and one or more other docking locations, e.g., a second docking location. In many practical applications of the present invention, the monorail vehicle traveling between many docking locations is equipped with an on-board robotic component for performing any number of operations at those docking locations.

The details of the invention, including its preferred embodiments, are presented in the below detailed description with reference to the appended drawing figures.

BRIEF DESCRIPTION OF THE DRAWING FIGURES

Figure 7A:
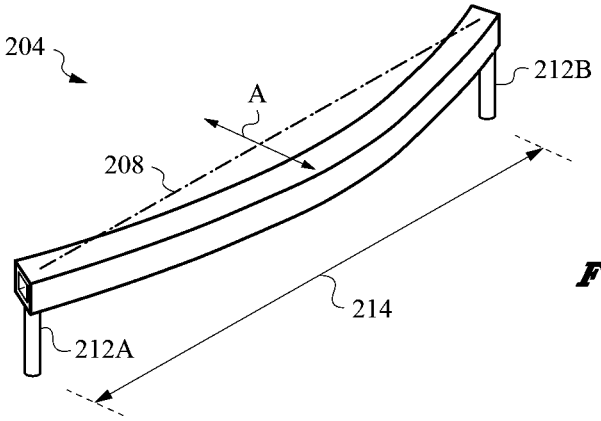
Figure 7B:
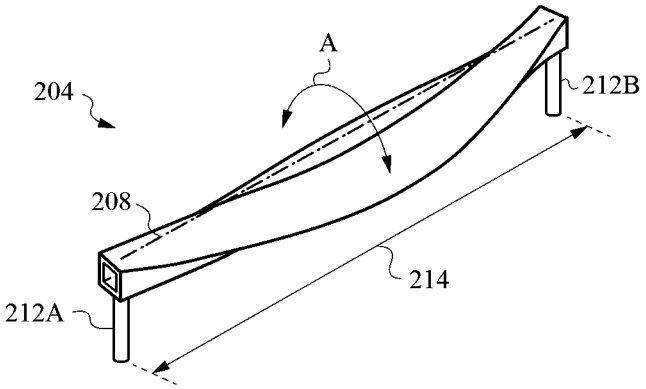

FIG. 7A-B are isometric views illustrating lowest order transverse and torsional modes experienced by an unsupported span of non-featured rail.

Figure 8:
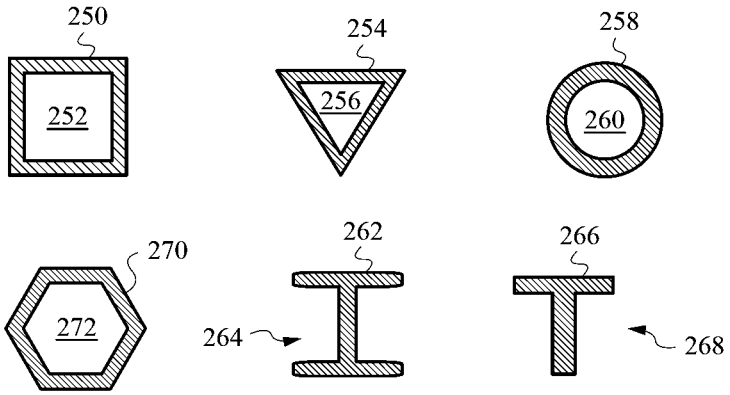

FIG. 8 is a cross-sectional plan view of various non-featured rail cross-sections that may be deployed in a monorail vehicle apparatus of the invention.

Figure 5:
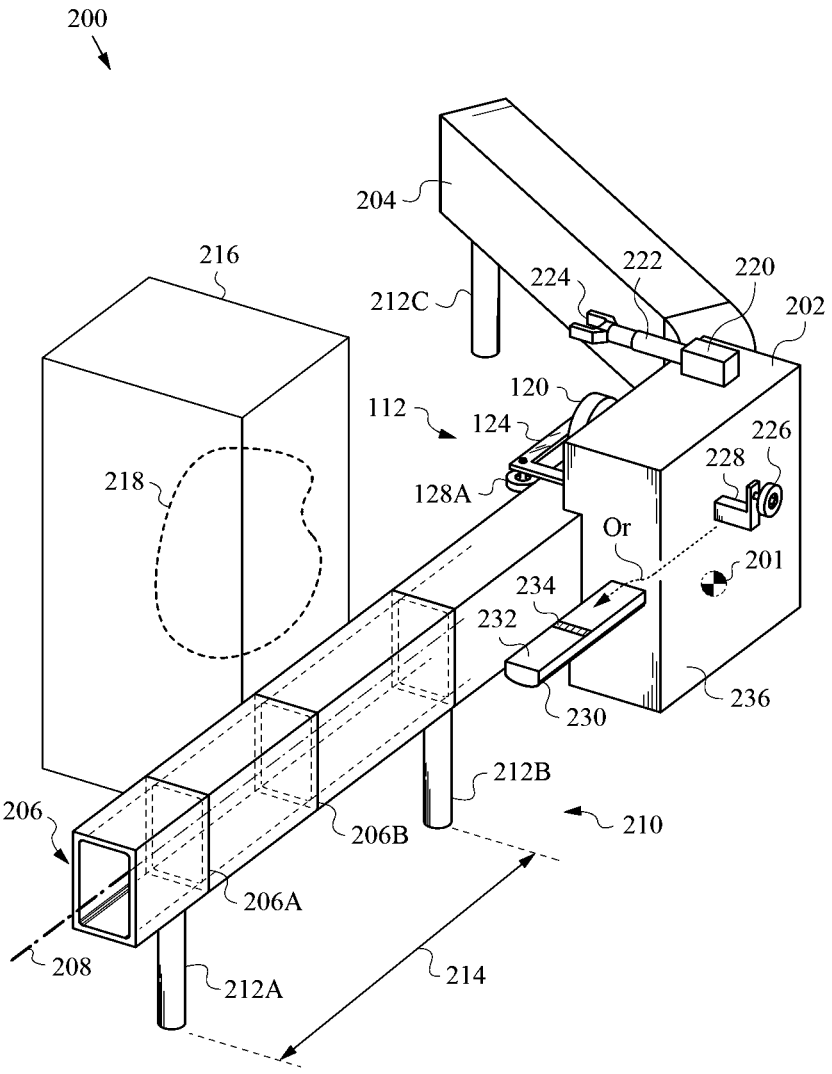
FIG. 5 is an isometric view of another monorail vehicle apparatus according to the invention.
Figure 9:
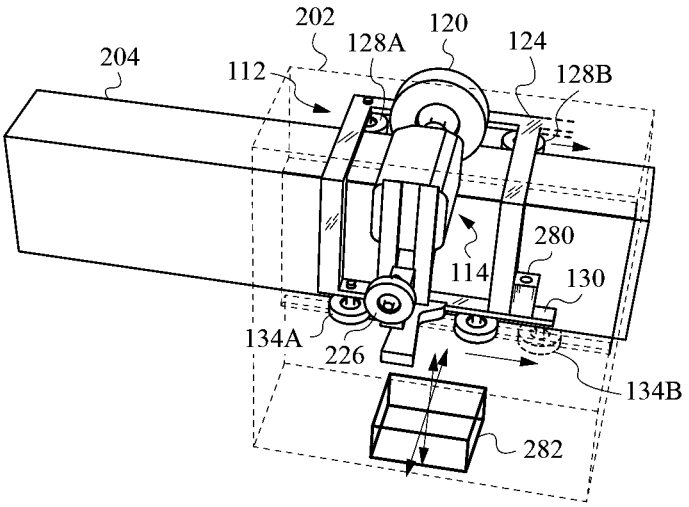

FIG. 9 is a perspective view of the monorail vehicle of FIG. 5 equipped with an adjustment mechanism according to the invention.

Figure 10A:
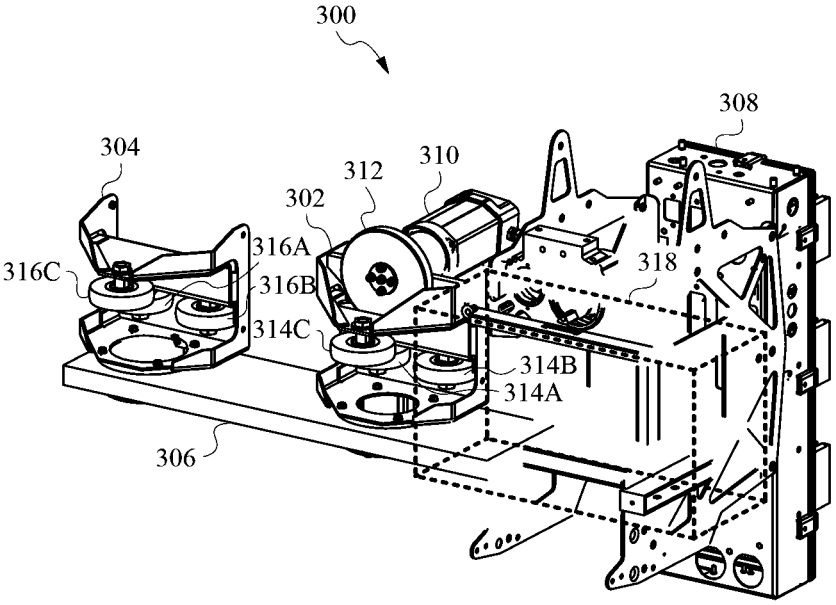

FIG. 10A is an isometric view of yet another monorail vehicle according to the invention.

Figure 10B:
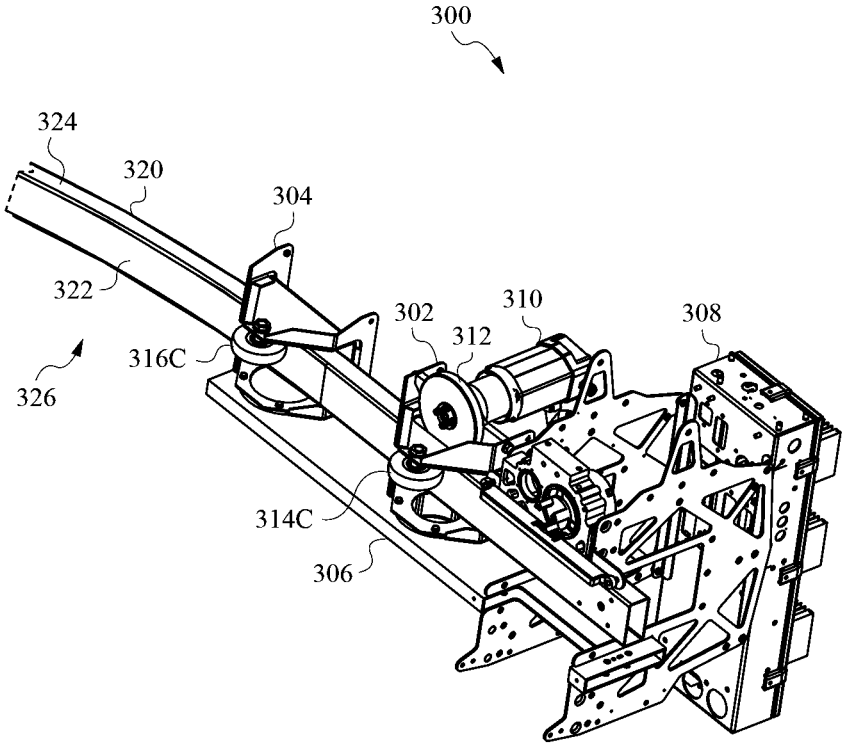

FIG. 10B is an isometric view of the monorail vehicle of FIG. 10A deployed on a non-featured rail in accordance with the invention.

Figure 11:
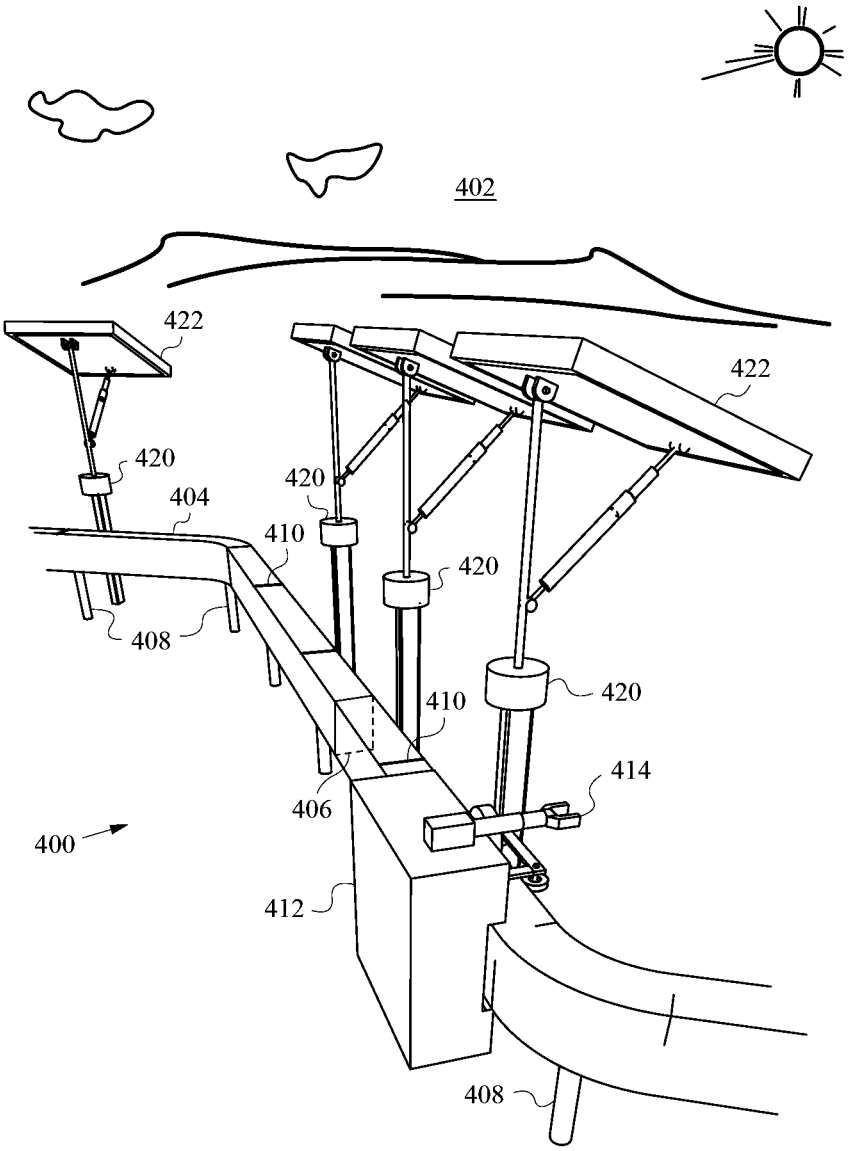

FIG. 11 is a perspective view of a monorail vehicle apparatus deployed to adjust mechanisms at docking locations in an outdoor environment.

Figure 12:
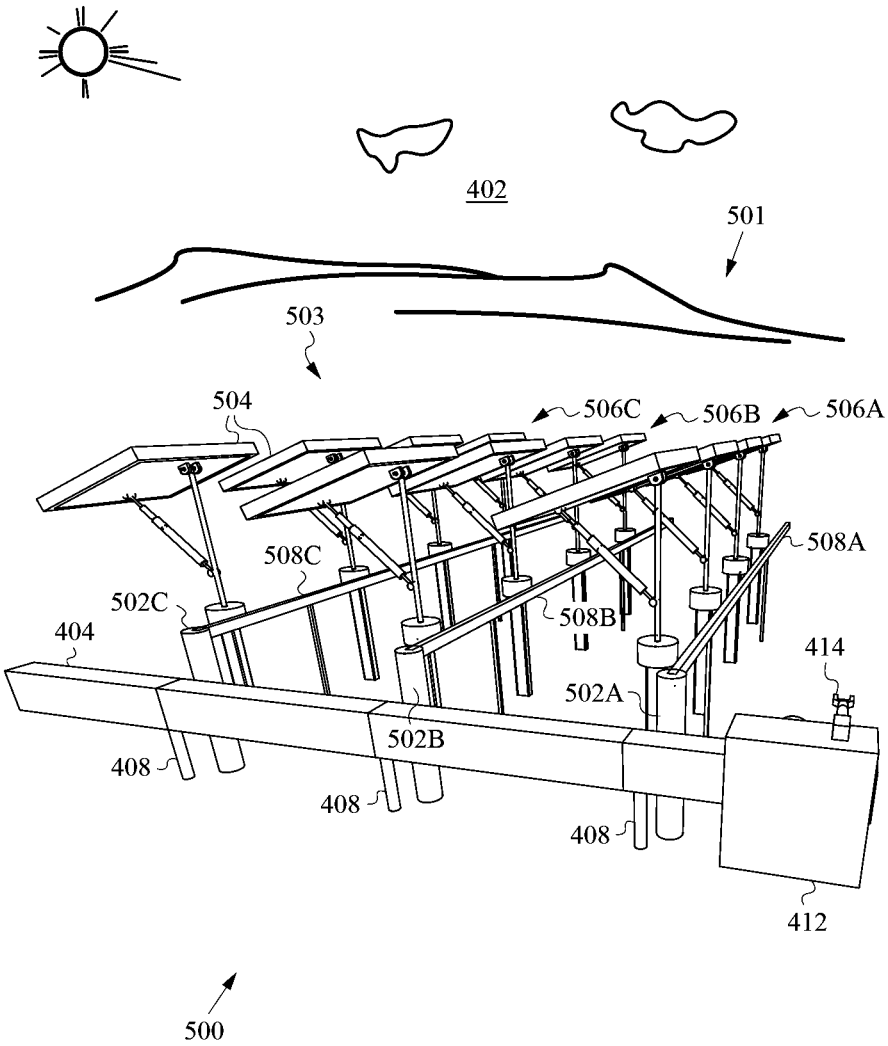

FIG. 12 is a perspective view of a monorail vehicle apparatus analogous the one shown in FIG. 11 deployed to adjust entire rows of single axis trackers configured in a solar array.

DETAILED DESCRIPTION

The figures and the following description relate to preferred embodiments of the present invention by way of illustration only. It should be noted that alternative embodiments of the structures and methods disclosed herein will be readily recognized as viable options that can be employed without departing from the principles of the claimed invention.

Reference will now be made to several embodiments of the present invention, examples of which are illustrated in the accompanying figures. Similar or like reference numbers are used to indicate similar or like functionality wherever practicable. The figures depict embodiments of the present invention for purposes of illustration only. One skilled in the art will readily recognize from the following description that alternative embodiments of the structures and methods illustrated herein may be employed without departing from the principles of the invention described herein.

Figure 1:
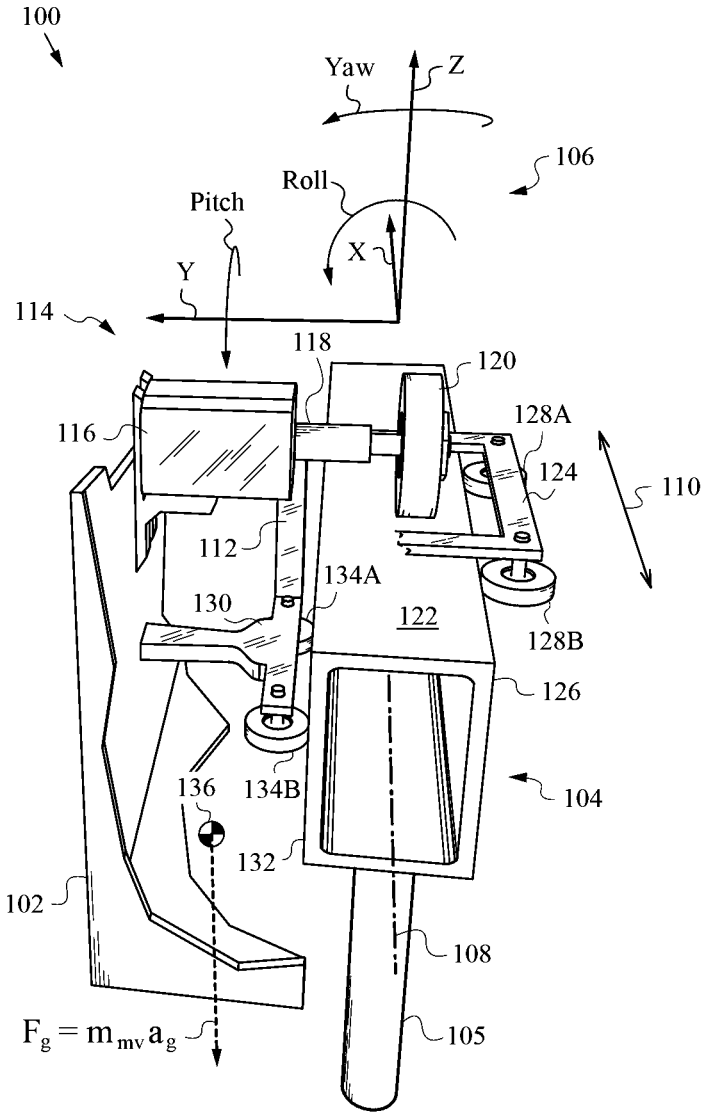
FIG. 1 is a perspective view of a monorail vehicle apparatus according to the invention.

The present invention will be best understood by first reviewing the embodiment of a monorail vehicle apparatus 100 shown in a perspective view by FIG. 1. A monorail vehicle 102 belonging to apparatus 100 travels along a non-featured rail 104 that is supported on one or more posts or mechanical supports 105. To understand the mechanics of the travel of monorail vehicle 102 we first review the definitions of relevant parameters in an appropriate coordinate system 106. We also note that monorail vehicle 102 is not shown in full in FIG. 1. In fact, a substantial portion of monorail vehicle 102 is cut-away in this view for clarity.

It is convenient that coordinate system 106 be Cartesian with its X-axis, also referred as the longitudinal axis by some skilled artisans, being parallel to a rail centerline 108 along which non-featured rail 104 extends. Both, rail centerline 108 and X-axis are also parallel to a displacement arrow 110 indicating the possible directions of travel of monorail vehicle 102. It should be noted that arrow 110 shows that vehicle 102 can travel in either direction. In other words, vehicle 102 can travel in the positive or negative direction along the X-axis as defined in coordinate system 106. Furthermore, coordinate system 106 is right-handed, and its Y- and Z-axes define a plane orthogonal to the direction of travel of vehicle 102.

In addition to linear movement along any combination of the three axes (X,Y,Z) defined by coordinate system 106, monorail vehicle 102 can also rotate. A total of three rotations are available to vehicle 102, namely about X-axis, about Y-axis and about Z-axis. These rotations are indicated explicitly in FIG. 1 by their corresponding names, specifically: roll, pitch and yaw. Although many conventions exist for defining three non-commuting rotations available to rigid bodies in three-dimensional space, the present one agrees with conventions familiar to those skilled in the art of mechanical engineering of suspensions.

In total, the body of monorail vehicle 102 thus has six degrees of freedom; three translational ones along the directions defined by the axes (X,Y,Z) and three rotational ones (roll, pitch, yaw). The translational degrees of freedom are also referred to in the art as longitudinal translation along rail 104 (X-axis), lateral translation (Y-axis) and vertical translation (Z-axis). A major aspect of the present invention is focused on controlling the roll of monorail vehicle 102 about X-axis without the use of mechanisms such as opposing springs.

For reasons of completeness, it should be remarked that when two of the rotational degrees of freedom of monorail vehicle 102 are fixed, namely pitch and yaw in the present embodiments, roll can be treated without special provisions. In other words, it can be calculated directly in fixed coordinate system 106. On the other hand, when pitch and yaw are allowed to vary considerably, the rotations have to be considered in a body coordinate system of monorail vehicle 102 and corresponding rotation convention (e.g., Euler rotation convention) has to be adopted to ensure correct results.

Monorail vehicle 102 has a bogie 112. Bogie 112 has a drive mechanism 114 for moving or displacing vehicle 102 along non-featured rail 104 in either direction along the X-axis, as also indicated by displacement arrow 110. Although a person skilled in the art will recognize that any suitable drive mechanism 114 may be used, the present embodiment deploys a motor 116 with a shaft 118 bearing a drive wheel 120. Drive wheel 120 is engaged with a top surface 122 of non-featured rail 104. Thus, motor 116 can apply a corresponding torque to rotate shaft 118 and thereby wheel 120 that is engaged with top surface 122 to move monorail vehicle 102 along the longitudinal direction defined by the X-axis. Given a sufficient contact force, in this case provided primarily by the mass of monorail vehicle 102, as discussed in more detail below, drive mechanism 114 can displace monorail vehicle 102 along the positive or negative direction along X-axis as indicated by displacement arrow 110.

Bogie 112 is equipped with a first assembly 124 for engaging non-featured rail 104 on a first rail surface 126. In the present embodiment, first rail surface 126 is a planar exterior side surface of rail 104. Note that planar exterior surface 126 on which assembly 124 travels is not directly visible in the perspective view afforded by FIG. 1. In the preferred embodiment, first assembly 124 uses one or more idler wheels for engaging with first surface 126. Specifically, in the present case first assembly 124 has two idler wheels 128A, 128B that are designed to roll along the upper portion of first surface 126.

Further, bogie 112 has a second assembly 130 for engaging non-featured rail 104 on a second rail surface 132. In the present embodiment, second rail surface 132 is a planar exterior surface of rail 104 that is geometrically opposite first surface 126. Second surface 132 is not directly visible in the perspective view of FIG. 1, just like first surface 126. Additionally, just as in the case of first assembly 124, second assembly 130 preferably uses one or more idler wheels for engaging with second surface 132. In fact, second assembly 130 has two idler wheels 134A, 134B that are designed to roll along the lower portion of second surface 132. Together, first and second assemblies 124, 130 constrain both the roll and the translational degrees of freedom of monorail vehicle 102.

In accordance with the invention, a center of mass or center of gravity 136 of monorail vehicle 102 is located at a certain offset from rail centerline 108. Thus, a gravitational force vector $F_g$ corresponding to the force of gravity acting on center of gravity 136 is off-center from the point of view of rail centerline 108 of rail 104. In accordance with Newton's Second Law, gravitational force vector $F_g$ is given by:

$$\vec{F}_g = m_{mv}\vec{a}_g \quad \text{(Eq. 1)}$$

where the over-arrows indicate vector quantities, the mass of monorail vehicle 104 is $m_{mv}$ and the vector due to Earth's gravitational acceleration is $a_g$.

Figure 2:
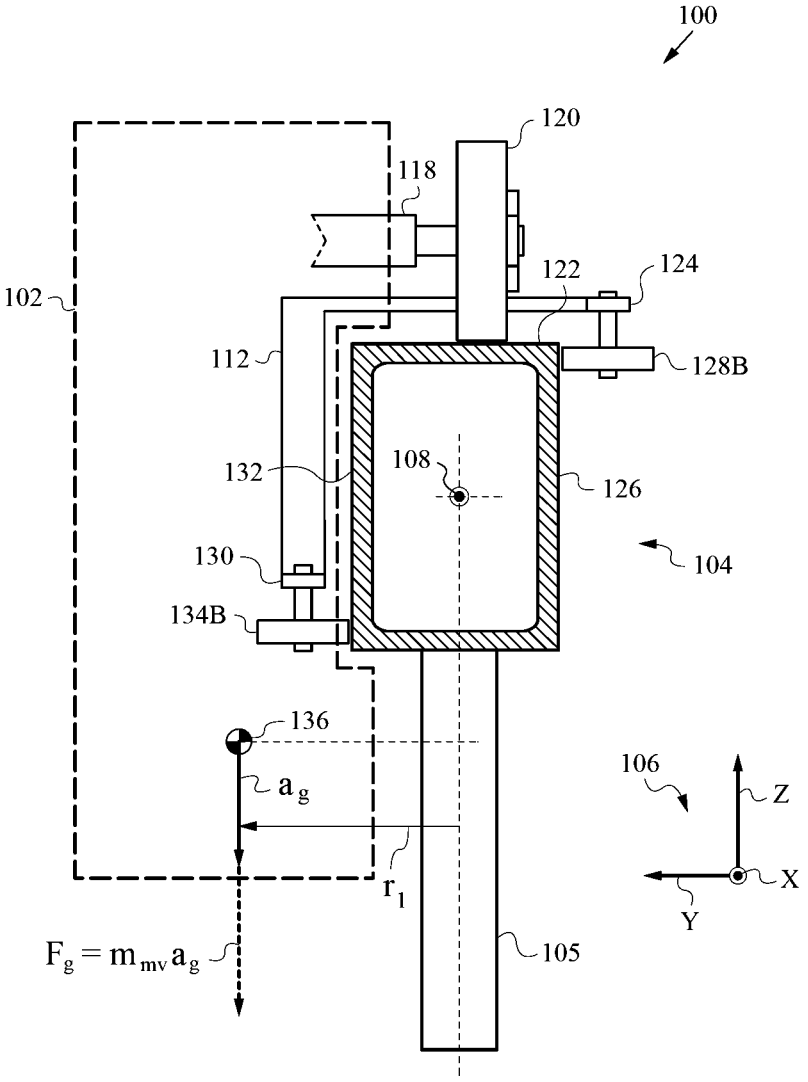
FIG. 2 is a partial elevation view of the monorail vehicle apparatus of FIG. 1 showing the effects of lateral offsets $r_1$ on roll moment $N_r$.

To examine the effects of the offset of center of gravity 136 we now refer to FIG. 2, which is a partial elevation view of monorail vehicle apparatus 100 as seen along the positive X-axis of coordinate system 106. In this view it is apparent that center of gravity 136 has a lateral offset along the Y-axis that defines the lateral displacement. More precisely, center of gravity 136 exhibits a lateral offset $r_1$ as measured along the lateral direction (along the Y-axis) from rail centerline 108.

Lateral offset $r_1$ of center of gravity 136 produces a roll moment $N_r$ about rail centerline 108. From mechanics, we know that the value of roll moment $N_r$ about an axis, rail centerline 108 in this case, is determined by the mass $m_{mv}$ of monorail vehicle 102 and the value of lateral offset $r_1$.

Figure 3:
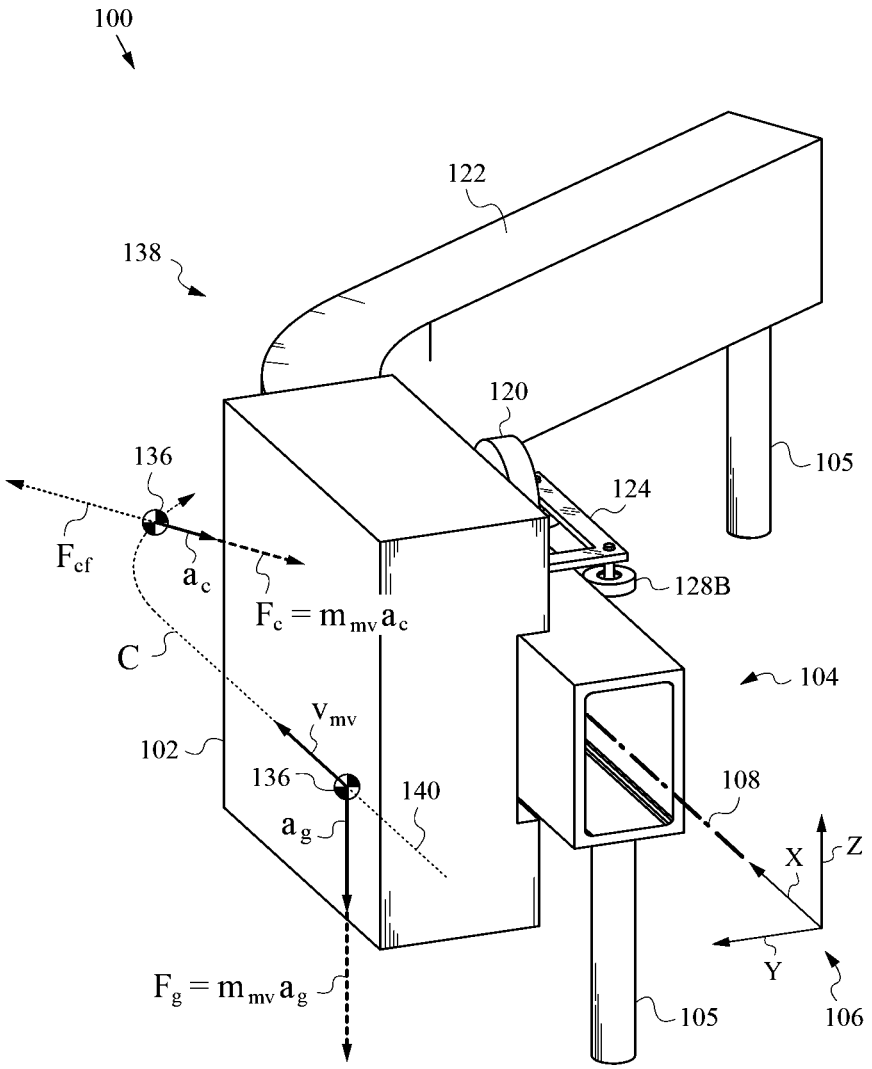
FIG. 3 is an isometric view of a monorail vehicle apparatus illustrating the dynamics of monorail vehicle of FIG. 1 traveling around a curve in a non-featured rail.

To better understand the dynamics of monorail vehicle 102 traveling along non-featured rail 104 and the corresponding choices in the exact placement of center of gravity 136 we now turn to FIG. 3. For simplicity, the following analysis assumes constant velocity of the monorail vehicle and neglects deflection and wheel stiffness. In this drawing monorail vehicle 102 is moving along the positive X-axis on non-featured rail 104. The displacement is produced by drive wheel 120 of drive mechanism 114 (see FIG. 1). Monorail vehicle 102 thus propelled moves with certain constant velocity as indicated by velocity vector $v_{mv}$ (where $v_{mv}=dx/dt$).

Non-featured rail 104 of apparatus 100 shown in FIG. 3 has a left curve 138 characterized by a certain radius of curvature. Since vehicle 102 is confined to travel along rail 104 by bogie 112, and more precisely by idler wheels 128A, 128B and 134A, 134B of first and second assemblies 124, 130 belonging to bogie 112 (see FIG. 1), vehicle 102 is forced to execute a left turn along left curve 138. Thus, a trajectory 140 of center of gravity 136 of vehicle 102 follows a corresponding dashed arrow C.

While traveling along the straight section of rail 104, vehicle 102 experiences the downward force of gravity described by gravitational force vector $F_g$ acting on center of gravity 136. Once in left curve 138, however, an additional centripetal force is generated, as indicated by corresponding centripetal force vector $F_c$. Applying Newton's Second Law again, we learn that the centripetal force vector $F_c$ acting on the interface between vehicle 102 and rail 104 in curve 138 is given by:

$$\vec{F}_c = m_{mv}\vec{a}_c \quad \text{(Eq. 2)}$$

where $a_c$ denotes the centripetal acceleration vector and is computed from the time-derivative of velocity vector $v_{mv}$ ($a_c = dv_{mv}/dt$). When vehicle 102 maintains a constant magnitude in velocity vector $v_{mv}$ while going through curve 138, e.g., by supplying a sufficient drive force via drive wheel 120, then centripetal acceleration vector $a_m$ is only due to the change in direction of velocity vector $v_{mv}$. Differently put, when the magnitude of velocity $v_{mv}$, commonly referred to as speed, is kept constant ($|v_{mv}|$=speed=constant), then the magnitude of acceleration vector $a_c$ is dictated just by the geometry of curve 138, i.e., by its radius of curvature $r_{turn}$. Under these conditions, the magnitude of centripetal acceleration $a_c$ is equal to:

$$a_c = \frac{v_{mv}^2}{r_{turn}} \quad \text{(Eq. 3)}$$

We note that due to the generally low speeds of vehicle 102, e.g., between 1 and 3 meters per second, no other forces need be considered.

For purposes of explanation, it is additionally helpful to treat the problem with an "imaginary" force, sometimes called the centrifugal force, indicated by centrifugal force vector $F_{cf}$ acting on center of gravity 136. Notice that $F_{cf} = -F_c$, as these vectors are pointing in exact opposite directions and have the same magnitudes.

When going through curve 138, the centrifugal force will tend to displace center of gravity 136, and hence entire vehicle 102 from its equilibrium position in which only the gravitational force is active. As a result, vehicle 102 tends to roll when making turns. This effect due to the centrifugal force has to be taken into account in the present invention when determining the preferred location of center of gravity 136.

Figure 4:
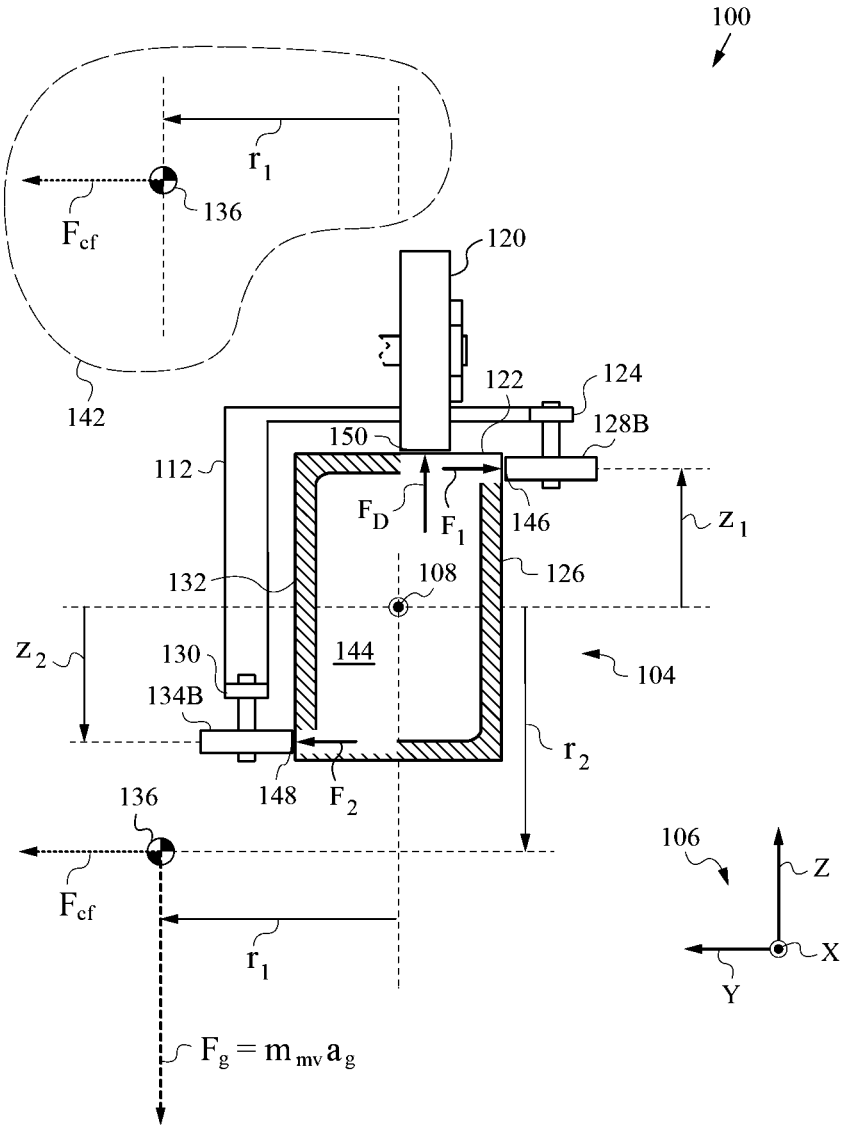
FIG. 4 is a partial elevation view of the monorail vehicle apparatus of FIG. 1, illustrating the effects of vertical offset $r_2$ on the stability of the monorail vehicle.

In view of the above considerations we turn to FIG. 4 to examine in more detail the preferred placement of center of gravity 136. FIG. 4 is a partial elevation view of vehicle 102 in which a vertical offset $r_2$ of center of gravity 136 from rail centerline 108 is shown explicitly. With lateral offset $r_1$ fixed, vertical offset $r_2$ along Z-axis can in principle take on any value without changing roll moment $N_r$ about centerline 108, as is clearly seen by referring back to Eq. 2A or Eq. 2B.

In principle, vertical offset $r_2$ can be set above rail centerline 108 or below it. With vertical offset $r_2$ above rail centerline 108, as shown in the dashed inset 142 in FIG. 4, any displacement of vehicle 102 in the positive roll direction will tend to decrease the roll moment $N_r$. By contrast, if center of gravity 136 is located below rail centerline 108, as shown in FIG. 4, any displacement of vehicle 102 in the positive roll direction will create a roll moment that augments the displacement. This means that if center of gravity 136 of vehicle 102 is above centerline 108 as in inset 142, then it is more susceptible to losing contact, which can be defined as experiencing forces or displacements that set $N_r<0$. If $N_r$ is less than 0, then vehicle 102 will go over-center, lose contact with rail 104 and become non-functional.

Forces other than the centripetal force can create the same effect of going over-center. Some of these other forces may be in effect even when vehicle 102 is not in motion, e.g., forces caused by environmental factors, such as those created by cross-winds buffeting vehicle 102 when operating outdoors.

In contrast, when vertical offset $r_2$ is below rail centerline 108 deviation from the nominal location of center of gravity 136 will produce an opposing moment to the displacement. This means that vehicle 102 will resist a larger displacement before $N_r$ becomes less than 0 and the wheels lose contact. For the reasons stated above, it is preferable that center of gravity 136 exhibit vertical offset $r_2$ below centerline 108. With this choice, monorail vehicle 102 will resist larger perturbations (e.g. forces or displacements) without moving out of its nominal roll attitude. Together, proper choice of lateral offset $r_1$ and vertical offset $r_2$ thus permit for adjustment of roll moment $N_r$, loading and also the stability of vehicle 102.

We now discuss the selection of specific suitable lateral and vertical offsets $r_1$ and $r_2$ in practice. In particular, the loading of assemblies 124, 130 engaged with rail 104 depend on how monorail vehicle 102 is attached to or mounted on non-featured rail 104. Thus, the geometry of bogie 112, and more specifically the locations and orientations at which drive wheel 120, idler wheels 128A, 128B of first assembly 124 and idler wheels 134A, 134B of second assembly 130 engage with non-featured rail 104 do matter.

In the preferred embodiment, a rail cross-section 144 of non-featured rail 104 is rectangular. Alternatively, a square rail cross-section 144 is also advantageous. In the preferred embodiment shown here, first and second rail surfaces 126, 132 on which corresponding idler wheels 128A, 128B and 134A, 134B engage and travel are geometrically opposite. Indeed, first and second surfaces 126, 132 are the opposite exterior side walls of non-featured rail 104.

The desirable gravity-induced effects on monorail vehicle 102 as presented in FIG. 4 can be examined in more detail by noting points of engagement 146, 148 of idler wheels 128B, 134B of first and second assemblies 124, 130 on rail 104 (wheels 128A, 134A are not visible in FIG. 4, but the same applies to them). Points of engagement 146, 148 are on the upper portion of first surface 126 and on the lower portion of second surface 132, respectively. The distances above and below centerline 108 of points of engagement 146, 148 along the Z-axis are denoted by $z_1$ and $z_2$, respectively. A point of engagement 150 of drive wheel 120 on top surface 120 of rail 104 is also shown for reference.

Given this geometry, we can now derive the appropriate process for selecting lateral and vertical offsets $r_1$, $r_2$ to achieve performance of monorail vehicle 102 in accordance with the present invention. Again our example assumes steady state and constant velocity. We also neglect vehicle compliance. The moment due to center of gravity 136 being off-center and the above-discussed forces on vehicle 102 produce surface normal reaction forces $F_1$ and $F_2$. The latter act along the Y-axis on corresponding idler wheels 128B, 134B at points of engagement 146, 148 with rail 104 and have to sum to zero ($\Sigma F_y=0$). In addition, the sum of all moments must equal to zero, in other words:

$$-F_1 z_1 - F_2 z_2 + m_{mv} a_g r_1 - m_{mv} a_c r_2 = 0 \quad \text{(Eq.4)}$$

From the fact that $\Sigma F_y=0$ and from Eqs. 3 and 4 the magnitude of surface normal reaction forces $F_1$, $F_2$ can be derived. For example, in the simplest case where $z_1=z_2=z$ we obtain the following expression for $F_2$:

$$F_2 = \frac{1}{2z}\left(m_{mv} a_g r_1 - \frac{m_{mv} v^2 r_2}{r_{turn}}\right) \quad \text{(Eq. 5)}$$

Of course, in the present case the forces are distributed over both wheel pairs 128A, 128B and 134A, 134B (see FIG. 1), rather than just wheels 128B, 134B that are visible in FIG. 4.

In practical design situations, it is desirable that all wheels remain in contact with rail 104 at all times. This means that $F_1$ and $F_2$ should be greater than zero at all times. Thus, we can calculate a safety factor SF that represents that safety margin for each engaging assembly 124, 130 before it loses contact with rail 104. For example, the safety factor SF is given by:

$$SF = \frac{a_c r_1 r_{tum}}{v_{mv}^2 r_2} \quad \text{(Eq. 6)}$$

Based on the above teachings a person skilled in the art will be able to derive the values of surface normal reaction forces $F_1$, $F_2$ for any given values of $z_1$ and $z_2$ and make a judicious choice of lateral and vertical offsets $r_1$, $r_2$ in any given design of monorail vehicle 102.

There are shear forces on idler wheels 128A, 128B and 134A, 134B at points of engagement 146, 148 on upper and lower portions of surfaces 126, 132 of rail 104. These shear forces are usually of secondary importance and are not computed herein. Properly chosen rounded wheel shapes, wheel material and structural design can be deployed to minimize shear forces and ameliorate their effects (e.g., excessive wheel wear and tear). In addition, cross-section 144 of rail 104 as well as location of points of engagement 146, 148 and engagement angles of idler wheels 128A, 128B and 134A, 134B can be altered too.

At this point, it is important to recognize that the adjustment in roll moment $N_r$ and loading of vehicle 102 according to the invention have been accomplished without the use of any spring elements. Again, with center of gravity 136 at lateral and vertical offsets $r_1$, $r_2$ and with first and second rail surfaces 126, 132 being the geometrically opposite external side surfaces of non-featured rail 104 we obtain the pair of surface normal reaction forces $F_1$, $F_2$ as computed above. These surface normal reaction forces $F_1$, $F_2$ describe the desired gravity-controlled roll attitude of monorail vehicle 102 and also the loading at engagement points 146, 148 with rail 104 as a function of vehicle geometry and gravity, and independent of profile variation of rail 104.

FIG. 5 is an isometric view of a monorail vehicle apparatus 200 in which roll attitude and loading are controlled by proper placement of center of gravity 201 of monorail vehicle 202. Monorail vehicle 202 is similar to vehicle 102. Corresponding parts of vehicle 202 therefore bear the same reference numbers as in vehicle 102. In addition, several aspects of the invention beyond gravity-controlled roll attitude and loading are addressed in this embodiment.

Figure 6:
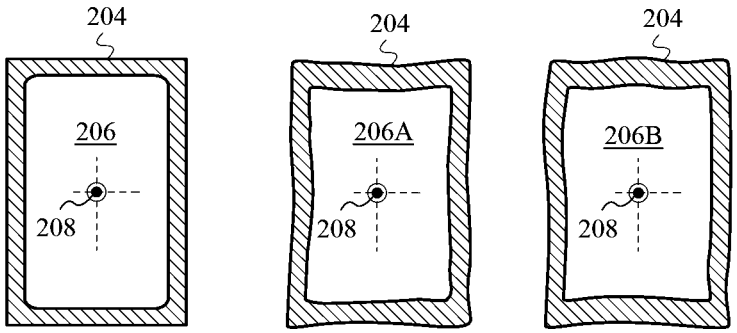
FIG. 6 are cross-sectional views of an ideal non-featured rail and two cross-sectional views of the non-featured rail of FIG. 5 showing its substantial variability.

Vehicle 202 travels on a non-featured rail 204 that has a rectangular cross-section 206 along its centerline 208. Rail 204 is made of a dimensionally stable material, such as a metal alloy, e.g., steel. However, cross-section 206 along centerline 208 of rail 204 is not uniform. In fact, FIG. 6 illustrates a substantial profile variation in the cross-section of rail 204 as compared to ideal rectangular cross-section 206. The locations of non-uniform cross-sections 206A, 206B taken along rail 204 and shown in FIG. 6 are indicated in FIG. 5 for reference. Note that the deviations from ideal cross-section 206 observed in cross-sections 206A, 206B of FIG. 6 are exaggerated for illustration purposes. In practice, a typical variation in a low-grade stock rail may be about 5%. With typical cross-sections, this translates to a variation ranging from one to a few millimeters.

In the prior art, such a system would struggle to be low-cost and at the same time meet performance requirements. In many applications it is desirable that a system use a low-cost, physically small closed-cross-section rail such as rail 204. A vehicle required to accurately locate on such a rail and constrained to the prior art, however, would face many disadvantages. For instance, if the vehicle were required to locate a point approximately 200 mm away from the center of the rail to within a few millimeters and were constrained to a guide rail by contact points separated by less than 100 mm, the vehicle would require springs with stiffness of about 400 N/mm. To ensure contact in spite of a 2 mm profile variation, which is a substantial profile variation, the engagement assembly would have to be nominally preloaded at 2 mm at all times. This would require in a minimum running load of 800 N and a maximum running load of 1,600 N. In turn, this prior art solution would result in high friction, lower lifetimes and decreased reliability.

Now, it is one of the advantageous aspects of the invention that monorail vehicle 202 can travel along low-grade rail 204 whose cross-section 206 exhibits such substantial profile variation along centerline 208 without experiencing variation in forces $F_1$ and $F_2$. This is possible because of gravity-controlled roll moment $N_r$ that sets the roll attitude of vehicle 202 and sets the loading of monorail vehicle 202 independent of rail geometry. In other words, apparatus 200 is insensitive to variations in rail width since the spring preload is determined not by an interfering pair of opposing springs, but by the constant mass of vehicle 202. Again, to restate the above teachings, moving center of gravity 201 away from rail 204 by lateral offset $r_1$ creates roll moment $N_r$ around rail 202 equal to $m_{mv}*a_g*r_1$ that is counteracted by forces on wheels of vehicle 202, namely $F_1$ and $F_2$. We thereby generate forces on idler wheels without using a mechanism that is dependent on rail geometry, as is the case with opposing springs.

Additionally, it is notable that roll moment $N_r$ sets the lateral location of vehicle 202 on rail 204. So long as the safety factor described above is greater than 1, the first and second assemblies that interface with rail 204 will remain in contact with rail 204. If those assemblies remain in contact, the lateral location of vehicle 202 is set. As with the roll attitude, then, the lateral location is constrained by vehicle characteristics and roll moment $N_r$.

Therefore, by using gravity rather than features on rail 204 or else springs to clamp rail 204 vehicle 202 does not incur the high cost, large pre-load and other disadvantages of prior art solutions and yet achieves performance of highly accurate lateral and roll location. In practice, increased tolerance to variation in rail cross-section 206 permits any apparatus of the invention to deploy low-quality stock rail 204 and thus reduce overall system cost.

Returning now to FIG. 5, we examine another important aspect of the invention related to a suspension 210 of rail 204. We demonstrate that the present invention delivers the required performance characteristics while permitting the use of a lighter rail spanning an unsupported distance, thereby decreasing the cost of the rail and of the apparatus as a whole. In the embodiment shown, suspension 210 consists of a number of posts 212. Three of these, namely posts 212A, 212B, 212C are visible in FIG. 5. Note that although posts 212 support rail 204 from below, side mounting of rail 204 to posts 212 with adjusted geometry is also practicable. In fact, the present invention applies to rail 204 suspended in any mechanically suitable manner known to those skilled in the art.

Irrespective of the actual method and type of suspension 210, rail 204 clearly has many mechanically unsupported spans. One such exemplary span 214 between posts 212A, 212B is indicated in FIG. 5. For reasons of mechanical stability span 214 of unsupported rail 204 between posts 212A, 212B needs to be limited to a maximum length $l_{max}$. It is desirable that rail 204, for reasons of cost, use as little material as possible.

Four main parameters govern rail 204: torsional stiffness, transverse bending stiffness, vertical bending stiffness and maximum stress. Cross-section 206 of rail 204 defines the relationship between these parameters and the amount of material required. Typical monorail cross-sections are illustrated in FIG. 8. For example, the I-profile 264 is popular for its tremendous stiffness in vertical bending.

To better understand the constraints on maximum length $l_{max}$ of span 214 according to the invention we refer to FIGS. 7A-B. These are isometric views illustrating the lowest order transverse and torsional modes experienced by unsupported span 214 of non-featured rail 204. Specifically, FIG. 7A shows the first transverse mode in which unsupported span 214 of rail 204 oscillates about centerline 208 in a plane parallel to the ground (not shown). Arrow A denotes the amplitude of this fundamental transverse mode. As is known in the art, amplitude A of any oscillation relates to the amount of energy carried by this mode. Further, it is also known that modes below 5 Hz are susceptible to excitation by environmental forces such as wind gusts.

In particular, we examine the torsional mode shown in FIG. 7B, in which unsupported span 214 of rail 204 twists about centerline 208. We treat the example as a massless beam and neglect the moment of inertia of the rail in this example. A more precise calculation would include the effective moment of inertia of the rail by summing it with the moment of inertia I of the vehicle. Given the parameters of span $l_{max}$, shear modulus G, polar moment of inertial J and rotational moment of inertia I of the vehicle, the torsional natural frequency $\omega_{nat}$ of span 214 including vehicle 202 can be approximately calculated as:

$$\omega_{nat} = \sqrt{\frac{G * J}{(I * l_{max})}} \quad \text{(Eq. 7)}$$

Once again, the amplitude of this first or fundamental torsional mode is indicated by arrow A. It is well known to those skilled in the art of mechanical engineering that cross-sections that do not describe a closed profile, i.e., "open cross-sections", have a polar moment of inertia, J, that is often two orders of magnitude lower that that of a closed cross-section or closed profile of equivalent linear density. It is therefore very desirable to use rail 204 with closed cross-section 206 that is rectangular.

FIG. 8 illustrates rails 250 and 254 with desirable cross-sections 252 and 256 that are square and triangular, respectively. Another desirable rail 258 with circular cross-section 260 is also shown. Triangular cross-section 256, however, is not widely available and therefore it is desirable to use rectangular cross-section 252 instead. FIG. 8 shows still another possible rail 270 with a desirable closed cross-section or profile afforded by a hexagonal cross-section 272. Based on these non-exhaustive examples a person skilled in the art will recognize that there are many other suitable cross-sections that are compatible with the apparatus and methods of the present invention.

For example, the use of rectangular cross-section 252 weighing 2.75 kg/m, a polar moment of inertia J of $3.6*10^{-7}$ $m^4$, a material with shear modulus 79 GPa, a 10 meter span and a vehicle with a moment of inertia of 3 $kg*m^2$, the apparatus will produce a torsional natural frequency $\omega_{nat}$ of about 5 Hz. An equivalent open cross-section 264 weighing about the same would exhibit a polar moment of inertia of about $1.14*10^{-9}$ $m^4$ and a natural frequency of about 0.3 Hz. As noted above, a low natural frequency $\omega_{nat}$, especially below 5 Hz, is problematic as it is susceptible to excitation. Therefore, it is advantageous to select a rail with closed cross-section.

As shown, the maximum length $l_{max}$ of span 214 differs with the choice of cross-section of non-featured rail 204. In the preferred embodiments cross-section 206 is rectangular, as already indicated, since it is clear from Eq. 7 that rectangular cross-section 206 offers high torsional stiffness and thus permits a larger maximum length $l_{max}$. This means that fewer posts 212 are required to suspend rail 204. In a typical embodiment, given a cross section of 0.075 m by 0.035 m maximum length $l_{max}$ is about 5 meters. Hence, a safe length of span 214 is anywhere from about one meter to 5 meters. However, other choices of rail cross-section are possible.

FIG. 8 shows in order of decreasing desirability a few other possible cross-sections that can be used in non-featured rails deployed in monorail vehicle apparatus of the invention. Specifically, rails 262 or 266 with I cross-section 264 or T cross-section 268 are not desirable. Normally, rails 258, 262 with T and I cross-sections 260, 264 are easy to obtain and offer features that a vehicle could grasp rendering them popular with monorails that do not have long unsupported spans and where $l_{max}$ is therefore kept short. However, since their torsional stiffness is typically one or two orders of magnitude lower than that of rectangular or square cross-sections 206, 252 they are not suitable in apparatus according to the present invention.

Due to reliance on featured rails, such as rails 262 or 266 with T and I cross-sections 260, 264, corresponding prior art monorail vehicles are poorly equipped to handle non-featured rails, such as rail 204 with rectangular cross-section 206 or other non-featured rails. Therefore, it is necessary to provide a method, as presented herein, to produce accurate alignment of monorail vehicles to non-featured rails.

First, it should be noted that some rail cross-sections, although closed, may not offer two geometrically opposite surfaces upon which idler wheels 128A, 128B, 134A, 134B can travel. In those situations surfaces on which idler wheels 128A, 128B, 134A, 134B travel are chosen to be oriented such that both the roll and lateral displacement degrees of freedom of bogie 112 are constrained by the travel surface. Of course, it is also possible for assemblies 124, 130 of bogie 112 to utilize glide elements other than idler wheels 128A, 128B, 134A, 134B. Appropriate choices include runners made of low-friction material.

Turning back to FIG. 5, we see that apparatus 200 further includes a docking location 216. A device 218 generally indicated in a dashed outline is located opposite vehicle 202 at docking location 216. Vehicle 202 is equipped with an on-board robotic component 220 for performing an operation on device 218, such as a mechanical adjustment. In the present embodiment, robotic component 220 has an extending arm 222 terminated by a robotic claw or grip 224 designed for the purposes of such mechanical adjustment.

Vehicle 202 is equipped with an outrigger assembly embodied by an outrigger wheel 226 on an extension 228 that is mechanically joined to bogie 112 for stability (connection not visible in FIG. 5). The purpose of outrigger wheel 226 is to assist in locating bogie 112 and hence entire vehicle 202 borne by bogie 112 at docking location 216. In fact, proper localization of vehicle 202 at station 216 is oftentimes crucial to ensure that on-board robotic component 220 be able to correctly grasp and execute the intended mechanical adjustment on device 218 with its grip 224.

Docking location 216 has a rail 230 for receiving outrigger wheel 226 of vehicle 202. In this specific embodiment, rail 230 is designed to receive wheel 226 such that it first rolls onto a top surface 232 and then along it. Of course, a person skilled in the art will recognize that a vast number of alternative mechanical solutions can be employed to receive outrigger wheel 226 at docking location 216.

Top surface 232 is additionally provided with an alignment datum 234. Datum 234 is intended to help in properly locating bogie 112 at docking location 216. Here, datum 234 is a mechanical depression that localizes outrigger wheel 226 on top surface 232 of rail 230. Once again, myriads of mechanical alternatives for achieving such localization are known to those skilled in the art. In fact, an additional wheel can be provided on bogie 112 or even directly on a housing 236 of vehicle 202 to accomplish the same result independent of outrigger wheel 226. Alternatively, localization can be ensured by non-mechanical means, e.g., optics, that are also well-known to those skilled in the art.

Apparatus 200 with non-featured rail 204 is designed for guiding monorail vehicle 202 between docking location 216 and other docking locations (not shown). Vehicle 202 travels between docking location 216 and other locations on unsupported spans of rail 204, as described above on the example of span 214. While in transit, gravity-controlled roll moment $N_r$ and loading of vehicle 202 ensure that idler wheels 128A, 128B, 134A, 134B maintain good contact with rail 204, despite its substantial profile variation (non-uniformity in cross-section 206).

During operation, as vehicle 202 travels along rail 204 and arrives at docking location 216 its outrigger wheel 226 moves as shown by arrow Or. Movement onto top surface 232 of rail 230 is accompanied by a slight lifting of vehicle 202. Then, outrigger wheel 226 comes to rest at datum 234 for the duration of mechanical adjustments performed by robotic component 220.

The further away wheel 226 is from non-featured rail 204, the larger the lever arm. Outrigger wheel 226 has to exert a roll moment on vehicle 202 and the larger the lever arm the smaller the contact force between surface 232 of rail 230 and outrigger wheel 226. This advantage of decreased force, however, must be balanced against considerations of packaging. A person skilled in the art will recognize the proper balance to be struck between these competing considerations.

The advantage of exercising control over roll attitude and loading of vehicle 202 through locating center of gravity 201 rather than through the use of a mechanism such as spring-loaded clamps now becomes clear. Specifically, setting lateral offset $r_1$ to achieve a certain roll moment $N_r$ translating into a desired roll attitude of about −5 to 5 degrees from vertical and setting vertical offset $r_2$ in the range of 0 to −40 mm for dimensions of rail 206 provided above is preferred.

In certain embodiments, as shown in the perspective view of FIG. 9, monorail vehicle 202 has an adjustment mechanism consisting of two units 280, 282 for adjusting a geometry of monorail vehicle 202. The adjustment performed by adjustment unit 280 affects at least one component belonging to one or more of the first and second assemblies 124, 130 and/or the drive mechanism 114. Meanwhile, adjustment unit 282 performs its adjustment by moving a ballast or, alternatively, by moving elements belonging to the payload (not shown) of vehicle 202. As a result, the placement of center of gravity 201 (see FIG. 5) of monorail vehicle 202 can be adjusted as indicated by the corresponding arrows.

Of course, units 280, 282 can work together by moving center of gravity 201 and at least one component of the first and second assemblies 124, 130 and/or the drive mechanism 114. Specifically, the relevant components moved by unit 280 in the example shown in FIG. 9 are wheels 128B, 134B belonging to assemblies 124, 130, respectively. In other words, unit 280 operates by moving wheels 128B, 134B as shown by the corresponding arrows.

Providing the apparatus of invention with adjustment mechanism for adjusting the placement of the center of gravity of the vehicle as well as changing the interfaces with the rail is advantageous. The adjustment mechanism with such capabilities can be deployed to alter the roll attitude, lateral translation and loads on the vehicle. For instance, adjustments to the interfaces with the rail can compensate for wear, deflection or mass growth of the vehicle. Further, such adjustments could change the values of offsets $r_1$ or $r_2$ to compensate for wear, deflection or mass growth of the vehicle. More precisely, such a provision could take the form of a cam-lock, screw, turnbuckle or pulley mechanism. The inclusion of this provision will allow the vehicle to maintain accurate roll attitude, lateral position and loading throughout its life.

In addition to the above aspects, the apparatus and method of invention can be further adapted to derive additional benefits. To explore some of these, we turn to FIG. 10A, which shows another exemplary monorail vehicle 300 with two rail-engaging assemblies 302 and 304. Assemblies 302, 304 are mounted on a bogie 306. Bogie 306, in turn, attaches to a chassis 308 of vehicle 300. In this embodiment, a drive mechanism 310 with a drive wheel 312 is integrated in first assembly 302. As in the previous embodiments, drive wheel 312 is designed to engage with a top surface of a non-featured rail (see FIG. 10B).

Assemblies 302, 304 are attached to bogie 306 such that they can pivot slightly about the vertical (Z-axis). Furthermore, assemblies 302, 304 are integrated in the sense that each actually serves the function of first and second assemblies as previously explained. To this effect, assembly 302 has three idler wheels 314A, 314B, 314C of which two, namely 314A, 314B are designed to engage with a non-featured rail on a first rail surface. Third idler wheel 314C is designed to engage with the non-featured rail on a second surface. Similarly, assembly 304 has two idler wheels 316A, 316B for engaging with the first rail surface and one idler wheel 316C for engaging with the second rail surface.

As taught above, a center of gravity of vehicle 300 that is not explicitly shown in the drawing is designed with lateral and vertical offsets. The lateral offset is selected to produce a pair of surface normal reaction forces resulting in gravity-controlled roll attitude of vehicle 300. The vertical offset is selected to adjust the gravity-controlled loading of vehicle 300. Because chassis 308 is adapted to permit various methods of mounting of its payload components (e.g., any robotic components and circuitry), the location of the center of gravity can be easily modified. A volume 318 is outlined in dashed lines to indicate the versatility in placement of the center of gravity to produce the desired roll attitude and loading. In other words, the center of gravity can be located anywhere in volume 318 by changing the location and manner of mounting any payload components.

FIG. 10B shows vehicle 300 traveling on a portion of non-featured rail 320. In this view, idler wheels 314C and 316C engaged with a second rail surface 322 are clearly visible. Meanwhile, idler wheels 314A, 314B and 316A, 316B engaged on the geometrically opposite surface of rail 320 are not visible. Drive wheel 312, meanwhile, propels vehicle 300 on a top surface 324 of rail 320.

Because assemblies 302, 304 are mounted to pivot on bogie 306, vehicle 300 tracks a curve 326 in rail 320 with ease. This additional aspect of the invention permits smaller radii of curvature and hence more design versatility in constructing apparatus in accordance with the invention.

Further, this arrangement allows for easy installation of vehicle 300 onto rail 320. By exerting a roll moment of $-N_r$ onto vehicle 300, an installer can roll vehicle 300 off rail 320 at any point. Once contact forces $F_1$, $F_2$ have gone to zero, vehicle 300 can be lifted off rail 320 in the Z-axis. Since $N_r$ is not large, a single person in the present embodiment can easily install or remove vehicle 300 without special tools or disassembly.

Additionally, as shown in FIG. 10B, vehicle 300 has only seven wheels 312, 314, 316 in contact with rail 320. A monorail vehicle of the same form engaging with the rail with a prior art mechanism such as that of opposing springs would require an additional four wheels to counteract the attendant forces and produce a stable roll attitude.

FIG. 11 illustrates a monorail vehicle apparatus 400 according to the invention deployed in accordance with the method of invention in an outdoor environment 402. Apparatus 400 uses a low-cost, non-featured rail 404 made of steel and having a rectangular cross-section 406. Rail 404 is suspended above the ground on posts 408 and has provisions 410 such as alignment data or other arrangements generally indicated on rail 404 for accurate positioning of a monorail vehicle 412 traveling on it.

Provisions 410 correspond to the locations of corresponding docking stations and are designed to accurately locate vehicle 412 at each one. Mechanical adjustment interfaces 420 for changing the orientation of corresponding solar panels 422 are present at each docking station. Further, vehicle 412 has a robotic component 414 for engaging with the interfaces 420 and performing adjustments to the orientation of solar panels 422.

In accordance with the invention, vehicle 412 can move rapidly between adjustment interfaces 420 on relatively long unsupported spans of low-cost rail 404 with rectangular cross-section 406 exhibiting substantial profile variation (as may be further exacerbated by conditions in outdoor environment 402, such as thermal gradients). These advantageous aspects of the invention thus permit rapid and low-cost operation of a solar farm while implementing frequent adjustments in response to changing insolation conditions.

FIG. 12 illustrates in a perspective view yet another monorail apparatus 500 similar to apparatus 400 that is also deployed in outdoor environment 402. Apparatus is used to operate a solar farm 501. As in the previous embodiment, apparatus 500 uses non-featured rail 404 made of steel, having a rectangular cross-section and suspended above the ground on posts 408 to support the travel of monorail vehicle 412. The provisions of the invention taught above ensure accurate positioning of monorail vehicle 412 on rail 404 at docking locations 502, of which only three, namely 502A, 502B and 502C are expressly shown for reasons of clarity.

Solar farm 501 has an array 503 of solar trackers with corresponding solar surfaces 504 that track the sun only along a single axis. In the present example, array 503 has many rows 506 of such solar trackers, of which only three rows 506A, 506B and 506C are indicated. Also, only three docking locations 502A, 502B and 502C associated with rows 506A, 506B and 506C are shown in FIG. 12.

Robotic component 414 of monorail vehicle 412 is designed to mechanically engage with suitable interface mechanisms at docking locations 502A, 502B and 502C to adjust the single axis angle of solar trackers in corresponding rows 506A, 506B, 506C. To adjust entire rows of solar trackers in a single operation each row 506A, 506B, 506C is equipped with corresponding linkage mechanisms 508A, 508B, 508C. Linkage mechanisms 508A, 508B, 508C transmit the adjustment performed by robotic component 414 at corresponding docking locations 502A, 502B, 502C.

In view of the above teaching, describing the apparatus, methods as well as several suitable applications a person skilled in the art will recognize that the invention can be embodied in many different ways in addition to those described without departing from the spirit of the invention. Therefore, the scope of the invention should be judged in view of the appended claims and their legal equivalents.

We claim:

1. A monorail vehicle apparatus wherein roll attitude and loading are constrained by the placement of a center of gravity, said apparatus comprising:

a) a non-featured rail extending along a rail centerline;

b) a monorail vehicle having a bogie for engaging said non-featured rail such that said center of gravity of said monorail vehicle has a lateral offset $r_1$ from said rail centerline thereby creating a roll moment $N_r$ about said rail centerline, said bogie comprising:

1) a drive mechanism for displacing said monorail vehicle along said non-featured rail;

2) a first assembly for engaging said non-featured rail on a first rail surface;

3) a second assembly for engaging said non-featured rail on a second rail surface, said first rail surface and said second rail surface being selected to produce a pair of surface normal reaction forces resulting in roll attitude and loading of said monorail vehicle being controlled by the placement of said center of gravity;

c) said non-featured rail substantially lacking interlocking feature(s) to mechanically constrain said bogie;

d) said non-featured rail further comprising an alignment datum for locating said bogie at a first docking location;

e) said docking location comprising at least one solar surface;

f) a robotic component for performing at least one mechanical operation on said at least one solar surface; and said center of gravity further having a predetermined vertical offset $r_2$ from said rail centerline.

2. The monorail vehicle apparatus of claim 1, wherein said predetermined vertical offset $r_2$ is below said rail centerline.

3. The monorail vehicle apparatus of claim 1, wherein said first rail surface is located geometrically opposite said second rail surface.

4. The monorail vehicle of claim 3, wherein a rail cross-section of said non-featured rail along said rail centerline is selected from the group of closed cross-sections consisting of rectangular cross-sections, square cross-sections, triangular cross-sections and hexagonal cross-sections.

5. The monorail vehicle apparatus of claim 4, wherein said rail exhibits a substantial profile variation along said rail centerline.

6. The monorail vehicle apparatus of claim 1, wherein said first assembly comprises an idler wheel.

7. The monorail vehicle apparatus of claim 1, wherein said second assembly comprises an idler wheel.

8. The monorail vehicle apparatus of claim 1, wherein said drive mechanism comprises a drive wheel engaged with a top surface of said non-featured rail.

9. The monorail vehicle apparatus of claim 1, wherein said non-featured rail has an unsupported span between a first docking location and at least one second docking location.

10. The monorail vehicle apparatus of claim 9, wherein said unsupported span has a length determined by minimum torsional stiffness, minimum lateral bending stiffness, minimum vertical bending stiffness and maximum material stress of said non-featured rail.

11. The monorail vehicle apparatus of claim 1, wherein said vehicle includes an adjustment mechanism for adjusting a geometry of said monorail vehicle to adjust said roll attitude and said loading on at least one component belonging to at least one of said first assembly, said second assembly and said drive mechanism.

12. The monorail vehicle apparatus of claim 11, wherein said adjustment mechanism moves said at least one component.

13. The monorail vehicle apparatus of claim 12, wherein said at least one component comprises at least one wheel.

14. The monorail vehicle apparatus of claim 1, wherein said adjustment mechanism moves said center of gravity.

15. The monorail vehicle apparatus of claim 1, wherein said mechanical operation comprises adjusting said at least one solar surface.

16. The monorail vehicle apparatus of claim 1, further comprising an outrigger wheel for assisting in locating said bogie at said first docking location.

17. A method for constraining roll attitude and loading of a monorail vehicle traveling along a non-featured rail extending along a rail centerline by the placement of a center of gravity, said method comprising the steps of:

a) providing said monorail vehicle with a bogie;

b) said non-featured rail substantially lacking interlocking feature(s) to mechanically constrain said bogie;

c) engaging said bogie with said non-featured rail such that a center of gravity of said monorail vehicle has a lateral offset $r_l$ from said rail centerline thereby creating a roll moment $N_r$ about said rail centerline;

d) moving said monorail vehicle along said non-featured rail with a drive mechanism;

e) providing said bogie with a first assembly for engaging said non-featured rail on a first rail surface;

f) providing said bogie with a second assembly for engaging said non-featured rail on a second rail surface, whereby said first rail surface and said second rail surface are selected to produce a pair of surface normal reaction forces for controlling said roll attitude and loading by the placement of said center of gravity;

g) locating said center of gravity at a vertical offset $r_2$ from said rail centerline;

h) providing an alignment datum on said non-featured rail for locating said bogie at a predetermined docking location;

i) providing at least one solar surface at said docking location; and j) providing a robotic component for performing at least one mechanical operation on said at least one solar surface.

18. The method of claim 17, wherein said predetermined vertical offset $r_2$ is below said rail centerline.

19. The method of claim 17, further comprising selecting said first rail surface geometrically opposite said second rail surface.

20. The method of claim 19, wherein said non-featured rail is chosen to have a rail exhibiting a substantial profile variation along said rail centerline.

21. The method of claim 17, wherein said first assembly is provided with at least one idler wheel.

22. The method of claim 17, wherein said second assembly is provided with at least one idler wheel.

23. The method of claim 17, wherein said drive mechanism is provided with a drive wheel to engage with a top surface of said non-featured rail.

24. The method of claim 17, wherein said non-featured rail has an unsupported span between a first docking location and at least one second docking location, a length of said unsupported span being determined by the minimum torsional stiffness, minimum lateral bending stiffness, minimum vertical bending stiffness and maximum material stress of said non-featured rail.

25. The method of claim 17, wherein said mechanical operation comprises adjusting said at least one solar surface.

26. A monorail vehicle apparatus wherein roll attitude and loading are constrained by the placement of a center of gravity, said apparatus comprising:

a) a non-featured rail extending along a rail centerline;

b) a monorail vehicle having a bogie for engaging said non-featured rail such that said center of gravity of said monorail vehicle has a lateral offset $r_l$ from said rail centerline thereby creating a roll moment $N_r$ about said rail centerline, said bogie comprising:

1) a drive mechanism for displacing said monorail vehicle along said non-featured rail;

2) a first assembly for engaging said non-featured rail on a first rail surface;

3) a second assembly for engaging said non-featured rail on a second rail surface, said first rail surface and said second rail surface being selected to produce a pair of surface normal reaction forces resulting in roll attitude and loading of said monorail vehicle being controlled by the placement of said center of gravity;

c) said non-featured rail substantially lacking interlocking feature(s) to mechanically constrain said bogie;

d) an adjustment mechanism for adjusting a geometry of said monorail vehicle to adjust said roll attitude and said loading on at least one component belonging to at least one of said first assembly, said second assembly and said drive mechanism; and said center of gravity further having a predetermined vertical offset $r_2$ from said rail centerline.

27. The monorail vehicle apparatus of claim 26, wherein said adjustment mechanism moves said center of gravity.

28. The monorail vehicle apparatus of claim 27, wherein said adjustment mechanism moves said at least one component.

29. The monorail vehicle apparatus of claim 28, wherein said at least one component comprises at least one wheel.

30. A monorail vehicle apparatus wherein roll attitude and loading are constrained by the placement of a center of gravity, said apparatus comprising:

a) a non-featured rail extending along a rail centerline;

b) a monorail vehicle having a bogie for engaging said non-featured rail such that said center of gravity of said monorail vehicle has a lateral offset $r_l$ from said rail centerline thereby creating a roll moment $N_r$ about said rail centerline, said bogie comprising:

1) a drive mechanism for displacing said monorail vehicle along said non-featured rail;

2) a first assembly for engaging said non-featured rail on a first rail surface;

3) a second assembly for engaging said non-featured rail on a second rail surface, said first rail surface and said second rail surface being selected to produce a pair of surface normal reaction forces resulting in roll attitude and loading of said monorail vehicle being controlled by the placement of said center of gravity;

c) said non-featured rail substantially lacking interlocking feature(s) to mechanically constrain said bogie;

d) said center of gravity further having a predetermined vertical offset $r_2$ from said rail centerline;

wherein said engagement of said bogie with said non-featured rail is secured by judicious placement of said center of gravity, without requiring conventional suspension means.

31. The monorail vehicle apparatus of claim 30, wherein said conventional suspension means are selected from the group consisting of springs, clamps, hydraulics, opposing wheels and pressure wheels.

* * * * *